US007851685B2

(12) United States Patent
Reiβner

(10) Patent No.: US 7,851,685 B2
(45) Date of Patent: Dec. 14, 2010

(54) FINGERING MECHANISM FOR WOODWIND INSTRUMENTS

(76) Inventor: Ernst Reiβner, Dillingerstr. 20, 86637 Wertingen (DE)

( * ) Notice: Subject to any disclaimer, the term of this patent is extended or adjusted under 35 U.S.C. 154(b) by 10 days.

(21) Appl. No.: 12/493,603

(22) Filed: Jun. 29, 2009

(65) Prior Publication Data

US 2009/0320667 A1 Dec. 31, 2009

(30) Foreign Application Priority Data

Jun. 27, 2008 (EP) ..... 08011714

(51) Int. Cl.
*G10D 9/04* (2006.01)

(52) U.S. Cl. ..... 84/380 R; 84/382; 84/384

(58) Field of Classification Search ..... 84/380 R, 84/382, 384
See application file for complete search history.

(56) References Cited

U.S. PATENT DOCUMENTS

| | | | | | |
|---|---|---|---|---|---|
| 512,449 | A | * | 1/1894 | Pupeschi | 84/380 R |
| 901,913 | A | * | 10/1908 | Julliot | 84/384 |
| 1,200,578 | A | * | 10/1916 | Bettoney | 84/382 |
| 1,317,219 | A | * | 9/1919 | Price | 84/382 |
| 1,336,359 | A | * | 4/1920 | Loomis | 84/380 R |
| 1,585,296 | A | * | 5/1926 | Loomis | 84/382 |
| 2,832,249 | A | * | 4/1958 | Lehmann | 84/382 |
| 2,867,146 | A | * | 1/1959 | Mazzeo | 84/382 |
| 3,017,798 | A | * | 1/1962 | Robbins | 84/382 |
| 3,079,828 | A | * | 3/1963 | Leblanc | 84/382 |
| 3,204,512 | A | * | 9/1965 | Mazzeo | 84/382 |
| 3,212,385 | A | * | 10/1965 | Acton | 84/382 |
| 3,238,833 | A | * | 3/1966 | Brodzky | 84/382 |
| 3,526,165 | A | * | 9/1970 | Robbins | 84/382 |
| 3,890,874 | A | * | 6/1975 | Vedder | 84/384 |
| 3,941,026 | A | * | 3/1976 | Hildebrandt | 84/382 |
| 4,723,470 | A | * | 2/1988 | Yamaryo | 84/380 R |
| 4,793,235 | A | * | 12/1988 | Yamaryo | 84/382 |
| 4,819,538 | A | * | 4/1989 | Nelson | 84/384 |
| 4,922,792 | A | * | 5/1990 | Yamaryo | 84/382 |
| 5,309,807 | A | * | 5/1994 | Kingma | 84/384 |

(Continued)

FOREIGN PATENT DOCUMENTS

FR 367 347 A 6/1906

(Continued)

OTHER PUBLICATIONS

Oboe Fingering Chart (first octave) by Timothy Reichard, © 1998-2005 cited at http://www.wfg.woodwind.org/oboe/ob_bas_1.html on Sep. 2, 2010.*

(Continued)

*Primary Examiner*—Elvin G Enad
*Assistant Examiner*—Robert W Horn
(74) *Attorney, Agent, or Firm*—Kolisch Hartwell, P.C.

(57) ABSTRACT

A fingering mechanism for a woodwind instrument that comprises a first key that actuates both a first tone hole, corresponding to the first key, and another remote tone hole. By closing the first key corresponding to the first tone hole, the first tone hole is closed only if a second tone hole that is closer to a mouthpiece, with respect to an air column in a tube of the instrument, than the first tone hole is closed as well.

21 Claims, 11 Drawing Sheets

U.S. PATENT DOCUMENTS

2009/0320667 A1* 12/2009 Reiβner ..... 84/380 R

FOREIGN PATENT DOCUMENTS

FR 452 348 A 5/1913
FR 1 240 588 A 9/1960
FR 1 429 882 A 2/1966
FR 2 584 222 A 1/1987

OTHER PUBLICATIONS

Oboe Fingering Chart (second octave) by Timothy Reichard, © 1998-2005 cited at http://www.wfg.woodwind.org/oboe/ob_bas_2.html on Sep. 2, 2010.*

Leon Goosens and Edwin Roxburgh, "Die Oboe", Fischer, Frankfurt am Main, Germany, 1983, pp. 219-223.

Leon Goosens and Edwin Roxburgh, "Yehudi Menuhin Music Guides: Oboe," Schirmer Books, New York, NY, 1977, pp. 211-215.

* cited by examiner

FINGERING MECHANISM FOR WOODWIND INSTRUMENTS

CROSS-REFERENCE TO RELATED APPLICATION

This application claims priority from European Patent Application 08 011 714.6 filed Jun. 27, 2008, which is incorporated herein by reference.

BACKGROUND

The present disclosure is directed to an improvement of the fingering mechanism for woodwind instruments, in particular for oboes. For wind instruments the pitch of a note corresponds to the length of the oscillating air column reaching in the tube principally from the mouthpiece to the first open hole. Woodwind instruments achieve a variety of tone pitches by abridging the tube acoustically by opening tone holes typically placed on the front side of the tube.

In this sense, transverse flutes are woodwind instruments although today they are typically made of metal, whereas alphoms, panpipes and organs are not.

The seven tones of an octave of a major scale require accordingly seven tone holes. Prior to the present disclosure, the tone holes of the woodwind instruments were placed in a way that an ascending scale can be played by closing all tone holes placed in a row on the front side of the tube and then raising sequentially one finger after the other bottom up. Regarded from the mouthpiece, all these fingerings close all tone holes up to a particular one. From this particular tone hole on, all following tone holes are open. Fingerings like this are called "linear" in the following. Fingerings requiring closing tone holes below the first open tone hole are called "cross fingerings."

To illustrate this, FIG. 1 represents an overview of the tone holes of the modern French Oboe for the tones Bb3 to C5, wherein closed tone holes are represented as filled circles and open tone holes as void circles. Additional holes which facilitate overblowing are not shown or represented, but only such holes that correspond to a note on the chromatic scale. Generally in this application, an annotation shall be used wherein "b" stands for "flat" and "#" for "sharp", e.g. Bb is B flat and has the same pitch as A# or A sharp. Where tone holes in FIG. 1 are labeled, they are given the same designation as the tone/pitch to which they correspond. To play the tone Bb4, i.e. A#4, the tone hole F# is closed in order to actuate a mechanism which opens tone hole Bb. In a similar matter, to play C5, i.e. B#4, the tone hole F# is closed in order to actuate a mechanism which opens tone hole C. These fingerings are cross fingerings. For all other tones, a linear fingering is given.

Compared to corresponding or neighbored linear fingerings, the cross fingerings tend to yield restrained or stuffy tones with reduced dynamics and instable intonation, more rarely notably and unpleasantly glaring tones with stronger dynamics.

The existence of cross fingerings side by side with linear fingerings and with other cross fingerings results in a heavily inhomogeneous sound. An extreme example for this are the adjacent tones Bb4 and C5 on the French Oboe.

Some people perceive the tone Bb4 as lyrical, others as stuffy. As a matter of fact, the dynamics is considerably reduced, the intonation however is unproblematic. The tone C5 in contrast, is glaring with strong dynamics and instable intonation.

Until fingering mechanisms were invented, tones of the diatonic scale were produced to a wide extent with linear fingerings, whereas black notes were generated with cross fingerings. That way, the inhomogeneity was not only hidden, but even justified. These days in contrast, where the full chromatic scale is desired, the inhomogeneity is considered spurious.

To avoid cross fingerings, each semitone requires a separate, tone hole. It is common practice to evolve the whole pitch range out of the lower octave by overblowing. This technique requires 12 tone holes, and possibly further holes which facilitate overblowing. A player cannot actuate all 12 tone holes with his 10 fingers, the more so as one finger holds the instrument and another one actuates the octave key which allows overblowing. This problem becomes even worse for instruments overblowing a twelfth instead of an octave.

Whereas the diatonic scale can be played with linear fingerings by closing the tone holes directly by the fingers, playing a chromatic scale in contrast, requires a fingering mechanism, which communicates the movement of the fingers to distant tone holes wherever necessary.

Today's fingering mechanisms eliminate cross fingerings to a wide extent and contribute that way to a homogeneous sound. Conversely, fingering mechanisms introduce additional cross fingerings, if a key is intended to actuate a remote tone hole but at the same time closes the tone hole below the key, although another tone hole which is closer to the mouthpiece with respect to the air column in the tube is open.

FIG. 1 illustrates the situation with the tones Bb4 and C5 on a French oboe, Système Conservatoire For both tones, the index finger presses the F# key in order to open the Bb-tone hole and the C-tone hole via a mechanism which is depicted schematically. At the same time, the F# key closes the F# tone hole below. Since, among other tone holes, the G tone hole, which is closer to the mouthpiece, is open, two cross fingerings occur.

The two fingering mechanisms for oboes competing against the Système Conservatoire avoid to close the F# key and by that the cross fingering by obtaining Bb4=A#4 from A4 and accordingly C5=B#4 from B4 by pressing another key.

To this end, the Vienna Oboe uses a trill key and loses by that smoothness of fingering and quality of tone. The English thumb plate system uses an additional thumb key and by that loses a considerable portion of pitch range because the thumb plate cannot be combined with the third octave key.

Oboes allowing both the fingering of the thumb plate system and of the Système Conservatoire do not combine the advantages of both systems; the performer may only choose the shortcoming which seems more acceptable. Typically, advanced performers are not willing to adopt new or additional fingerings. In practice, the thumb plate system is limited to countries of the Commonwealth of Nations, the Vienna Oboe to the city of Vienna and its philharmonic orchestra.

SUMMARY

The present disclosure applies to a fingering mechanism for woodwind instruments, in particular to oboes.

The fingering mechanism for a woodwind instrument comprises a first key that actuates both a first tone hole, corresponding to the first key, and another remote tone hole. By closing the first key corresponding to the first tone hole, the first tone hole is closed only if a second tone hole that is closer to a mouthpiece, with respect to an air column in a tube of the instrument, than the first tone hole is closed as well.

DETAILED DESCRIPTION

Figure 1:
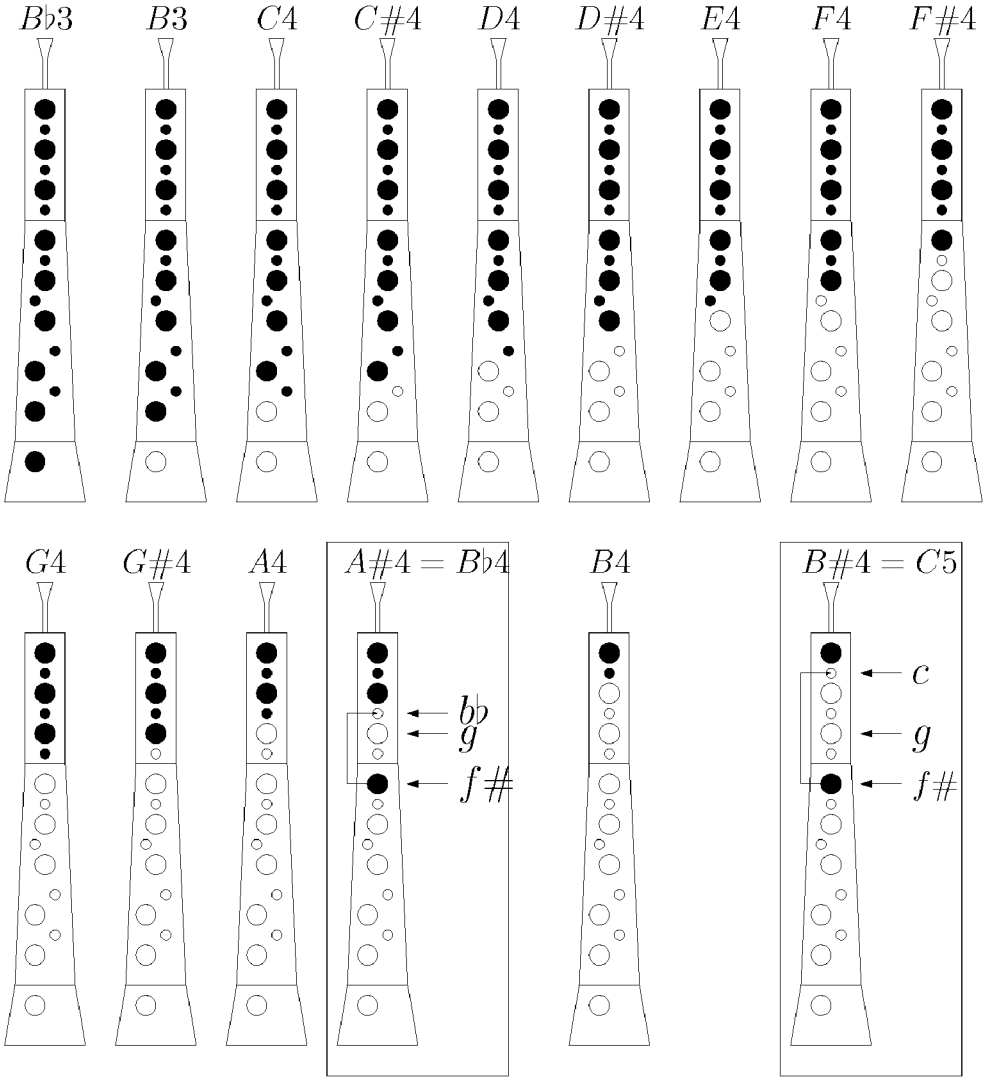
FIG. 1 is a schematic top view of an oboe with tone holes showing the fingerings according to the state of the art.

This fingering mechanism allows to press a first key without automatically closing the corresponding first tone hole, which—in the prior art fingering—would be the tone hole directly below the first key. Instead, the first tone hole is closed only if in addition at least one, sometimes even all, tone holes are closed which are closer to the mouthpiece.

That way, for a fingering in which a finger actuates a remote tone hole via a key mechanism, the present disclosure allows to prevent the tone hole which—in the prior art fingering—would be below the first key, from being closed automatically and unwantedly, except when a second tone hole closer to the mouthpiece is closed as well. In other words, preferably the first tone hole shall be closed only if second tone hole closer to the mouthpiece and the first key are both closed. Thereby, such cross fingerings which result in bad tone quality are avoided and as many tones as possible are implemented with linear fingerings. Moreover, the present disclosure allows to retain the traditional fingering.

The remote tone hole can be any tone hole which is distanced from the first key along the tube of the instrument, but which needs to be actuated by the first key via an intermediary mechanism. In most embodiments, this intermediary mechanism is part of the prior art fingering mechanism. Pressing the first key can either open or close the remote tone hole. The remote tone hole can be either further upward or downwards from the first tone hole along the air column in the instrument.

The present disclosure thus allows to close a remote half-tone hole, for an oboe preferably the C4 hole or the Bb4 hole, by actuating the first key without closing the first tone hole corresponding to the first key. For the oboe the first tone hole is preferably the F# tone hole.

The first key can be a type of key which normally is situated directly above a hole, even if the position of the first tone hole is modified such that it is not directly below the first key. The first key is for example a ring key, i.e. a key which is actuated by pressing it with the finger tip against the tube of the instrument, wherein the plate closing the tone hole has a hole in it. The hole can be very small, or not present at all. Thus, the first key may also be a plateau-key.

The same applies to the second key.

Most Preferably (but not always), the woodwind instrument is an oboe but the present disclosure is applicable also to other woodwind instruments, in particular to German Flutes, clarinets, oboe d'amore, English horn, bassoons and saxophones. Preferably (but not always), the instrument is a woodwind instrument with holes for whole tones and half-tones.

Applied to the notes Bb4 and C5 on the oboe, the present disclosure combines the advantages of the thumb plate system with the more established and agile fingering of the Système Conservatoire. The inventor has realized that linear fingerings tend to a clear and voluminous sound. With linear fingerings, the quality of sound depends only little on the pitch, which results in a homogeneous sound as a whole.

If the present disclosure is applied to Bb4 and C5 as remote tone holes on the oboe, those tones fit smoothly into the sequence of adjacent tones; C5 becomes more dolce, Bb4 becomes stronger but remains beautiful. The intensity is balanced and the intonation is without a difficulty.

According to an embodiment, the fingering mechanism of a French oboe is modified while maintaining the most established fingering of the Système Conservatoire. For example, the fingering mechanism is modified in a way that, when playing the notes Bb4, C5, Bb5 or C6, the F# key is prevented from closing the F# tone hole which is below the F# key although the fingering and all other acoustic properties of the tones are preserved. Instead, the F# tone hole is to be closed if and only if both the F# key and another key which is closer to the mouthpiece, for example the G key, are closed. This means that despite of retaining the traditional fingering, this fingering is no longer a cross-fingering.

For example, the first tone hole corresponds to a whole tone hole which—in the traditional fingering mechanism—is located directly below the corresponding key. According to the state of the art, this first key inevitably would close the first tone hole when the player presses the key, i.e. when the finger presses the key to the tube. Thus in the prior art, the first key actuates the first tone hole directly.

In contrast to this, the present disclosure suggests to modify the fingering mechanism and/or the first tone hole in a way, that the first key does not actuate the first tone hole directly but via a first intermediary mechanism, e.g. an actuating mechanism comprising e.g. a lever and/or a rocker and/or a shaft. This allows to design the fingering mechanism in a way that by pressing the first key, the first tone hole is not necessarily closed. There are various ways to reach this.

According to an embodiment, the first tone hole, for the oboe for example the F# tone hole, is not placed directly below the corresponding first key. It will usually have approximately the same distance from the mouthpiece along the air column in the tube of the instrument than the first key, though it can also be displaced by e.g. a few mm or cm. According to an embodiment, the first tone hole is rotated or shifted with respect to the first key along the circumference of the tube of the instrument. For example, the first key will be approximately "in line" with the other most-played keys, whereas the first tone hole is no longer in a line with the adjacent tone holes, but is relocated and closed by the first key for example via a first mechanism. This allows to insert a mechanism which does not automatically close the tone hole if the according key is pressed. Preferably the first tone hole is relocated with respect to the first key by about 20°-120°, more preferably 40°-100° and most preferably circa 90°+−5° along the circumferential line, for example in clockwise direction. The relocated tone hole is preferably not placed at the opposite site of the tube from the first key, which is at the bottom when playing the oboe, to avoid that condensed water flowing down inside the tube can block the tone hole.

The first key corresponding to this first tone hole remains at the same place, but does no longer close a tone hole below it. Instead, preferably a stopper made out of cork, rubber or plastic material, is fixed between the key and the tube to prevent the key from knocking against the tube, or at least to dampen the knocking.

This embodiment of the present disclosure relies on the knowledge that the acoustic properties, in particular the pitch, of a tone only depend on the distance of the tone hole from the upper end of the tube with the mouthpiece, wherein the distance is measured along the air column in the tube, which can of course be curved. As a consequence, a tone hole can be relocated along the circumferential line of the instrument without changing the pitch of the corresponding note.

According to an embodiment, a second mechanism prevents the first tone hole from being closed if the first tone hole is open. Preferably (but not always), this second mechanism is coupled with a second key corresponding to the second tone hole and is coupled with the first mechanism. The second tone hole can be located directly underneath the second key, or at least at the same position along the length of the tube of the instrument.

Both the first mechanism and the second mechanism preferably each comprise a rocker elastically held or loaded or charged in one of its two extreme positions by a resetting device. For example, each rocker has a so-called inclined position and a horizontal position. The resetting device can be a spring. The position of the first rocker is in principle changeable by actuating the first key, preferably by a lever mechanism, and the position of the second rocker is in principle changeable by actuating the second key, preferably via another lever mechanism. However, the two rockers preferably interlock at one end, such that the position of one rocker influences that of the other rocker. In one embodiment for example, if the second rocker is in the inclined position because the second tone hole is open, the first rocker will be held also in its inclined position, no matter whether the first key is actuated or not.

According to an embodiment, the first rocker comprises a plate for closing the first tone hole when the first rocker is in a horizontal position. Thus, if the first rocker is held in the inclined position by the second rocker, the first tone hole cannot close, even if the first key is pressed.

According to a first variant, one of the two rockers or both are at least essentially parallel to the main axis of the instrument, i.e. with a deviation of maximally 10° or 20°. According to a second variant, one or both rockers can be perpendicular to the axis of the tube, i.e. in circumferential direction of the tube, where with a deviation of maximally 10° or 20°.

According to a further variant, the fingering mechanism comprises an additional key, elastically held in a closed position by a resetting device and actuating the first tone hole. Most preferably (but not always), the keys corresponding with the first and the second tone hole are held open by a resetting device, e.g. a spring, and open the additional key if at least one of them is in the open position.

If the second tone hole is open, the fingering mechanism preferably prevents the first tone hole from being closed. Or in other words, the second key corresponding to the second tone hole detects whether the second tone hole is open. If the second tone hole is open, the second key prevents the first tone hole from being closed. Thereby, one can for example realize that by actuating the first key, another half-tone hole closer to the mouthpiece (in an oboe for example the B4 or C5 tone hole) is actuated, e.g. opened, as is often the case in known fingering mechanisms, without introducing a cross-fingering. In this way, the fingering mechanism allows for a chromatic way of playing and the realization of half-tones without cross fingerings.

Preferably (but not always), the first and the second tone hole are consecutive full tone holes. However, they can also be tone holes which have one, two or three tone holes in between. In case of the oboe they are preferably the F# hole and the G hole, respectively.

The fingering mechanism for woodwind instruments preferably has full tone and half tone holes.

The present disclosure is also directed to any woodwind instrument having a fingering mechanism as described above.

In the following, the present disclosure is explained based on embodiments applied to the oboe and referring to the Figures.

Preferably (but not always), the present disclosure is embodied as the modification of the fingering mechanism of the oboe and preferably the present disclosure is applied simultaneously to the notes Bb4 and C5. Then the F# tone hole corresponds to the first tone hole and, preferably the G tone hole corresponds to the second tone hole. Analogously, the F# key corresponds to the first key and the G key corresponds to the second key.

It is an object of the present disclosure to maintain the classical fingerings for woodwind instruments while transforming the fingering mechanism mechanically in a way that cross fingerings with bad tone quality are avoided. Those cross fingerings which are necessary e.g. for overblowing are not the subject of the present disclosure.

Figure 2:
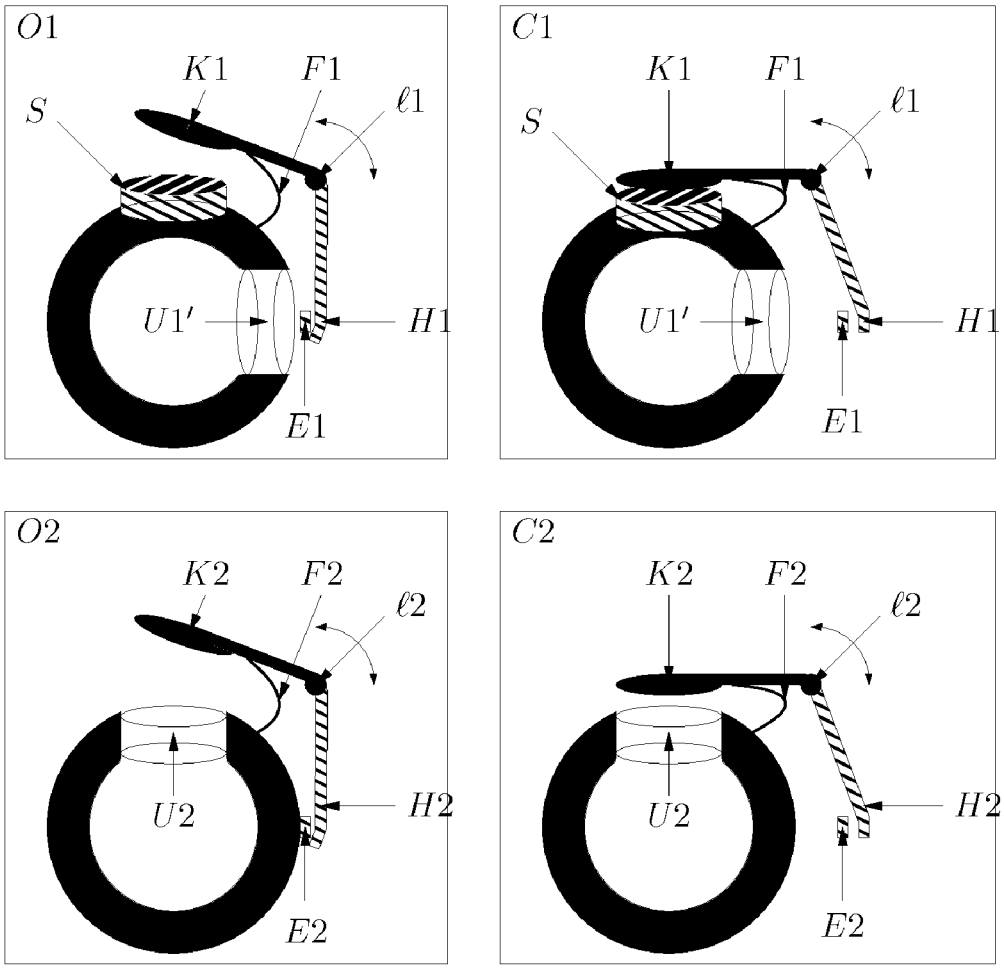
FIG. 2 are schematic sectional views through the upper part of an oboe in the vicinity of the first tone hole (Figures $O_1$ and $C_1$) and through the middle part of an oboe in the vicinity of the second tone hole (Figures $O_2$ and $C_2$). Both figures show the key open ($O_1$ and $O_2$) and closed ($C_1$ and $C_2$), from the viewpoint of the performer with a fingering mechanism according to the first embodiment.
Figure 3:
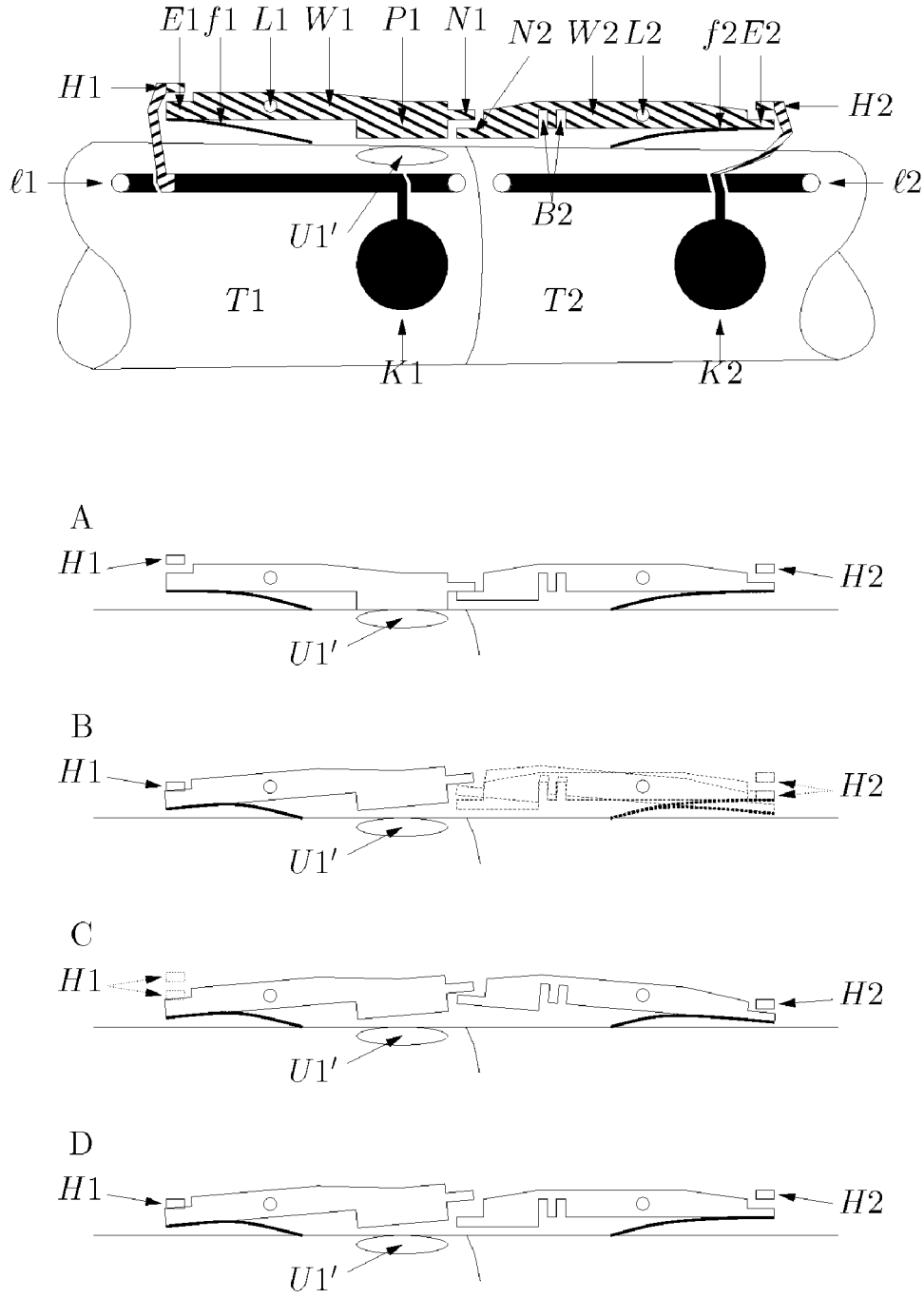
FIG. 3 are schematic lateral views on a section of the oboe of the FIG. 2 in the vicinity of the first and of the second tone hole, wherein the Figures A-D show a detail with a rocker mechanism in various positions.
Figure 4:
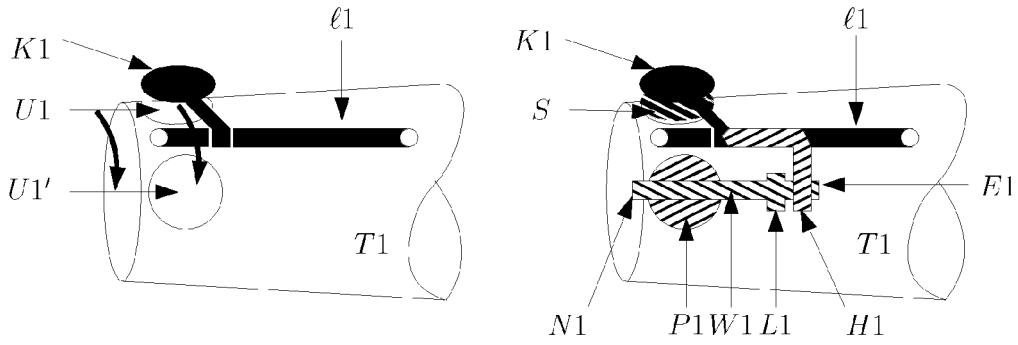
FIG. 4 are schematic views rotated about 90° on the lower joint of FIG. 3 without the first mechanism (left hand side) and with first mechanism (right hand side)

FIGS. 2 and 3 schematically show an oboe with a fingering mechanism according to the first embodiment, viewed from the mouthpiece along the main bore and in a lateral view, respectively. Additionally, FIG. 4 shows perspective views, in which the tone hole U1 is visible, which is in reality hidden by the key K1.

As can be seen in FIG. 2, the first key K1 is pivoted at the shaft I1 and is kept in "open" position, i.e. away from the tube, by a spring F1. By pressing the first key K1 in a prior art oboe, the prior art tone hole U1 (not shown in FIG. 2) which is just below the first key K1, would be closed. In the same way, the second key K2 acts on the second tone hole U2. The second key is pivoted at a shaft I2 which is the prolongation of I1 and is kept in open position by a spring F2. FIG. 3 shows, that K1, I1, F1 and U1 are usually located on the lower joint T1 of the oboe but close to the upper joint. Conversely, K2, I2, F2 and U2 are located at the upper joint T2 but close to the lower joint T1.

An aim of the present disclosure is to avoid that pressing the first key K1 closes the first tone hole below automatically. Preferably (but not always), this is reached by rotating the position of the tone hole U1 which is traditionally below the key K1 along the circumferential line as shown in the left hand part of FIG. 4. As a consequence, the tone hole U1 is replaced by U1'.

This embodiment of the present disclosure is based on the knowledge that the pitch of a tone hole depends only on the length of the air column to the mouthpiece.

Preferably (but not always), the rotation is chosen in a way that U1' is placed such that U1' is neither covered by K1, nor blocked by flowing condensation water and such that if needed there is enough room for an additional fingering mechanism. For the embodiment of the fingering mechanism described here, the preferred (but not required) relocation is a clockwise rotation of about 90° from the viewpoint of the performer. Preferably (but not always), the first key K1 remains on the spot. Preferably (but not always), U1 is replaced by a stopper S preventing K1 from knocking against the tube.

The tone hole U1' is no longer actuated directly by the first key K1 as is usual, but preferably by a lever H1 which is rigidly fixed to the key K1 but at the opposite side of the shaft I1 (see FIG. 3). In other words, the lever H1 can be displaced along the axial direction of the tube with respect to the first key. The lever H1 grips or catches or gears over the end E1 of a first rocker W1. The first rocker W1 has two extreme positions, which in the following will be called "horizontal" position and "inclined" position. However, this wording is chosen only because this is the way the two extreme positions of first rocker W1 appear in FIG. 3. Preferably (but not always), the first rocker W1 runs parallel to the shaft I1. At the end of W1 opposite to E1, a plate P1 is mounted to open and to close the tone hole U1' (see FIG. 3). The rocker W1 is pivoted at the bearing L1 between E1 and P1. A first spring f1 keeps the rocker W1 in the horizontal position in which the plate P1 closes the tone hole U1'. The whole mechanism is mounted on the lower joint T1 of the oboe. A nib N1 on the plate P1 at the end of W1 opposite to E1 reaches to the junction to the upper joint of the oboe. Thus, if the first key is pressed, the lever H1 is raised and allows the first rocker W1 (If not prevented by the second rocker, see below) to assume its horizontal position in which the first tone hole U1' is closed, driven by the action of the spring f1.

Symmetrically to the mechanism at the lower joint of the oboe, a second mechanism at the upper joint T2 includes a lever H2 which is rigidly fixed at the key K2 but at the opposite side of the shaft I2. The lever H2 catches or gears over the end E2 of a second rocker W2. The second rocker W2 has two extreme positions, which in the following will be called "horizontal" position and "inclined" position. However, this wording is chosen only because this is the way the two extreme positions of second rocker W2 appear in FIG. 3. Preferably (but not always), the second rocker W2 runs parallel to the shaft I2. At the end of W2 opposite to E2, a nib N2 is mounted which reaches to the lower joint T1 of the oboe. The second rocker W2 is pivoted at the bearing L2 between E2 and N2. A spring f2 keeps the rocker W2 in the horizontal position in which the nib N2 is close to the tube. The second key K2 is a traditional key to actuate the second tone hole U2 situated below K2.

Where upper joint T1 and lower joint T2 of the oboe touch, also the two mechanisms interlock with each other at the nibs N1 and N2. As shown in FIG. 3, the second nib N2 is below the first nib N1.

If the player presses K1 towards the tube, the lever H1 moves in the opposite direction, away from the tube, and releases the rocker W1. If in addition K2 is pressed, the lever H2 releases the rocker W2, as well. According to FIG. 3 A, driven by the springs f1 and f2, both rockers move into their horizontal position. Their nibs are close to the tube and U1' is closed.

If K1 is released, the spring F1 "opens" the key K1 and moves the lever H1 towards the tube. Overcoming the resistance of the spring f1, the first lever H1 inclines the rocker W1 into its inclined position and so P1 opens the tone hole U1'. As illustrated by FIG. 3 B, this holds independent of the position of the second key K2, and of the second lever H2.

If instead of the first key K1 the second key K2 is released, the spring F2 (see FIG. 2) "opens" the key K2, and the corresponding tone hole U2, and moves the lever H2 towards the tube. As shown in FIG. 3 C, the lever H2 inclines the second rocker W2 and so the nib N2 is distanced from the tube. Since both rockers are coupled via their nibs N1 and N2 adequately, e.g. the nib N2 touches N1 from below, also the first rocker W1 is inclined and U1' is opened, provided the spring F2 is stronger than f1 and f2 taken together. It will be appreciated that this holds independently of the positions of the first key K1, i.e. of the first lever H1.

Preferably (but not always), the second rocker W2 is provided with two indentations B2 which can be placed e.g. between the bearing L2 and the nib N2, as shown in the upper part of FIG. 3. The indentations serve to bridge the bearings mounted at this place for the traditional embodiment of the usual fingering mechanism. Preferably (but not always), the rocker W2 crosses these bearings perpendicularly. One of the bearings belongs to another rocker which itself must be provided with an indentation to bridge the lever H2.

Preferably (but not always), the ends of the rockers W1 and W2 shall be padded with cork and the levers H1 and H2 shall be provided with regulating screws. For sake of simplification, these parts are not shown in the Figures.

At the junction between the upper joint T2 and the lower joint T1, the two rockers of the fingering mechanism(s) touch at their nibs N1 and N2. To avoid that the oboe is damaged when connecting its two joints, it is usual to press the C-D trill key at the upper joint of the oboe and, at the opposite side, the rocker mentioned above. The fingering mechanisms require in addition to press the g key to put the rocker W2 into a horizontal position. As usual, the key K1 is left in normal position and so the rocker W1 is inclined. As shown in FIG. 3 D, the nib N2 is then close to the tube, whereas N1 is not. That way, the two joints are easily connected and disconnected.

The present disclosure under consideration works particularly well, if the two joints are connected by a bayonet coupling which is narrow enough to allow to place the F# tone hole at the "acoustically correct position", which is close to the site where the two joints touch.

An aspect of the present disclosure includes a way to close the tone hole U1 only if U2 and K1 are both closed. After having presented one embodiment of the present disclosure, some aspects are summarized below:

Preferably (but not always), the fingering mechanism and/or the first tone hole U1 are modified in a way, that the first key K1 does no longer close the first tone hole U1' automatically, wherefore the first tone hole can be modified if needed. Preferably (but not always), first tone hole U1' is no longer actuated, as it is traditionally, directly by the first key K1 but preferably by a plate P1 placed above U1.

For example, the plate is mounted on a rocker W1 pivoted in a bearing L1 and endowed with a resetting device, as e.g. a spring f1, which, if not outbalanced, keeps W1 in a horizontal position in which the plate P1 holds the tone hole U1' closed.

To determine whether the tone hole U2 is open, preferably a key K2 as described above is used. For fingering mechanisms of very traditional oboes, the key K2 and the resetting device must be added separately.

If both keys, K1 and K2 are pressed, i.e. if they are in closed position, the rocker W1 is in a horizontal position, in which the tone hole U1' is closed, as well. In contrast, if at least one of these keys are released, the resetting devices F1 or F2 of K1 or of K2, which outbalance f1, drive W1 into the inclined position, in which the tone hole U1' is open.

To give an impression of the diversity of the possible embodiments we present other embodiments in the following:

In the first embodiment which is shown in FIG. 3, the end E2 of the rocker W2 is between the lever H2 and the tube; the spring f2 keeps W2 horizontal.

Thereby, by closing a particular key, such as K1, corresponding to a first tone hole U1, this tone hole U1 is not closed automatically but only if another tone hole U2, which is closer to the mouthpiece, is closed as well. For the oboe, the first tone hole U1' is preferably the f# tone hole and the second tone hole U2 is the g tone hole.

Figure 5:
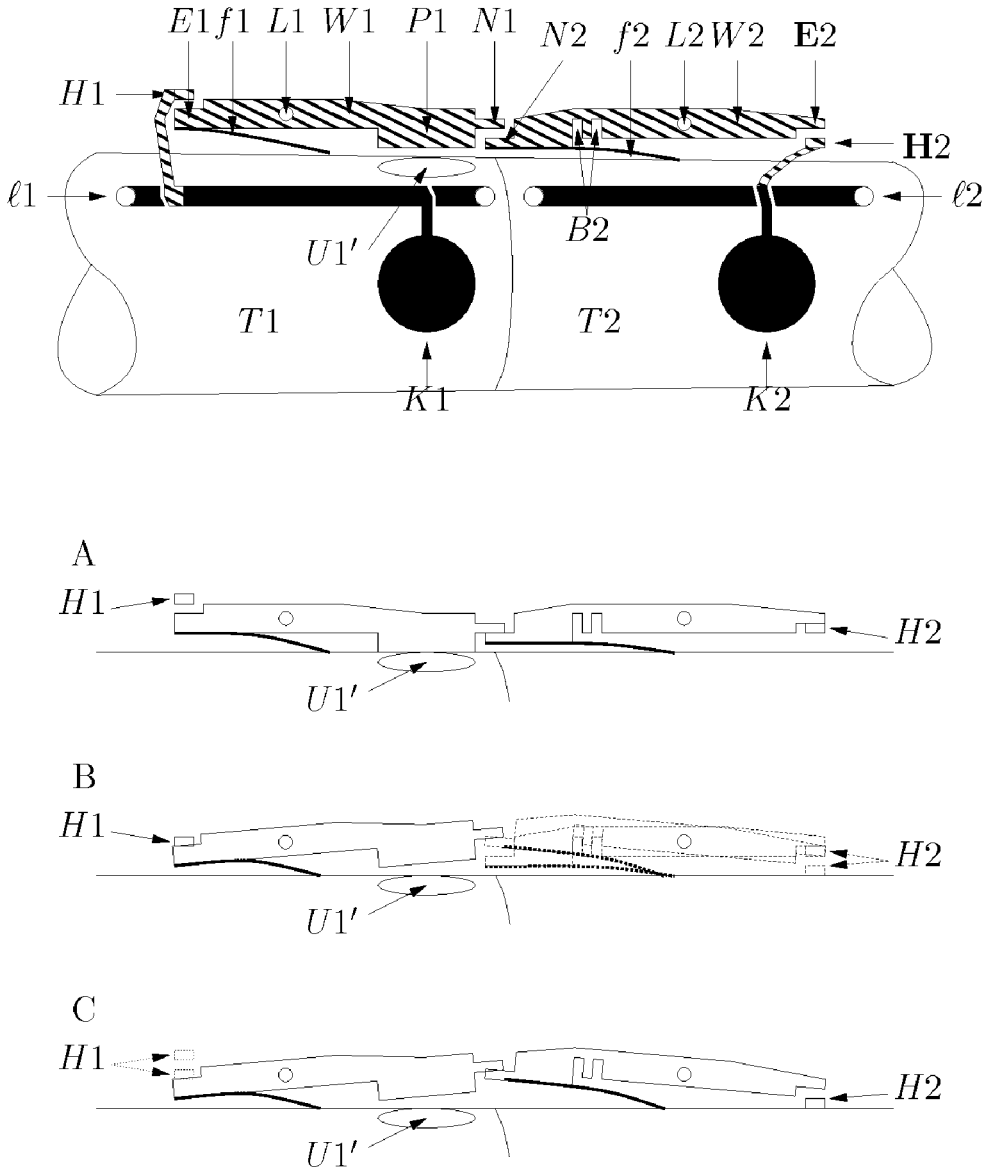
FIG. 5 are schematic lateral views on a section of the oboe with fingering mechanism according to the second embodiment in the vicinity of the second tone hole. Figures A-D only show sections with the rocker mechanism in various positions.
Figure 6:
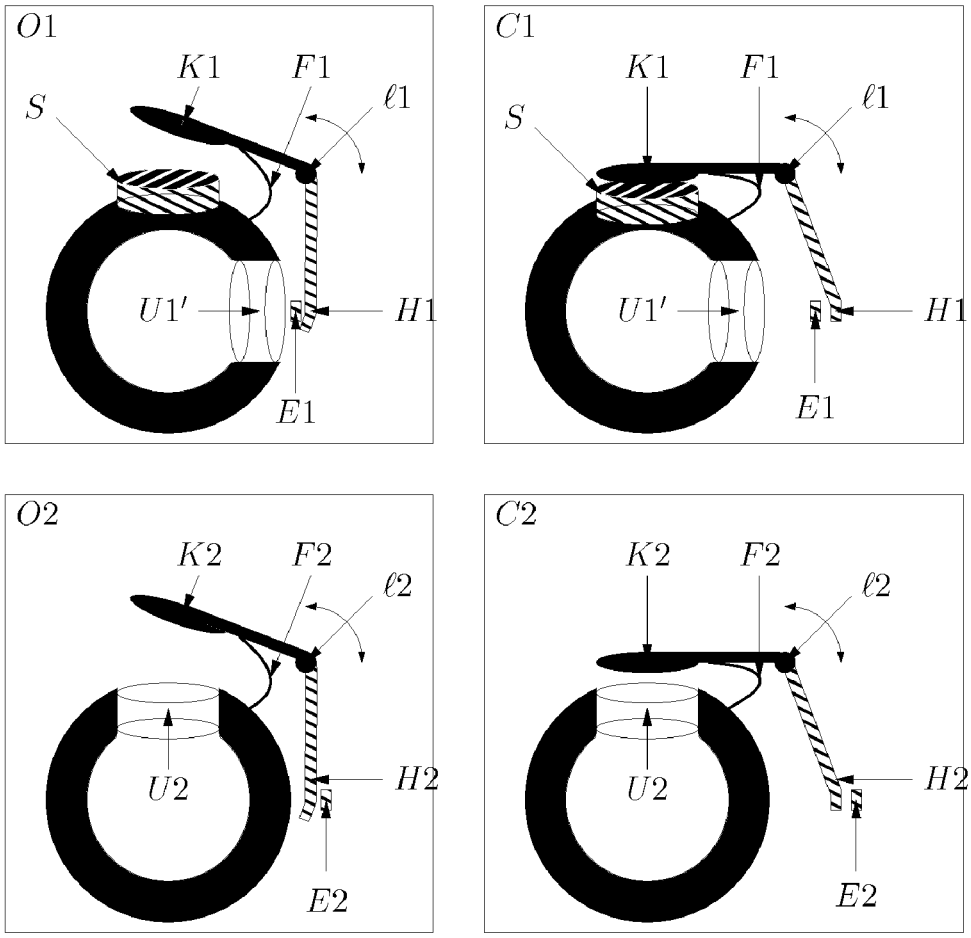
FIG. 6 are schematic sectional views through the upper joint of an oboe in the vicinity of the first tone hole (Figures $O_1$ and $C_1$) and through the lower joint of an oboe in the vicinity of a second tone hole (Figures $O_2$ and $C_2$) from the point of view of the player with a fingering mechanism according to the second embodiment with keys in open position ($O_1$ and $O_2$) and in closed position ($C_1$ and $C_2$)

Another or an equivalent mechanism according to FIGS. 5 and 6 arises, if the lever H2 is between the tube and the end E2 and if at the same time the spring f2 is mounted in a way that, without further influences, it inclines the rocker W2 as shown in the upper part of FIG. 5, if f2 alone outbalances the spring f1. Thus, compared to the first embodiment, this second one can be realized a little easier. A regulating screw must be mounted at E1 instead of H1.

Figure 7:
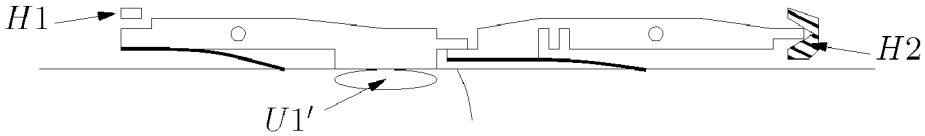
FIG. 7 is a schematic lateral view on a detail of the fingering mechanism in the vicinity of the first and the second tone hole according to a third embodiment.

According to a third embodiment, the end E1 of the rocker W1 and the lever H1 can be realized in a way that they move simultaneously if they are linked as illustrated in FIG. 7. One of the springs F2 or f2 is obsolete then.

Figure 8:
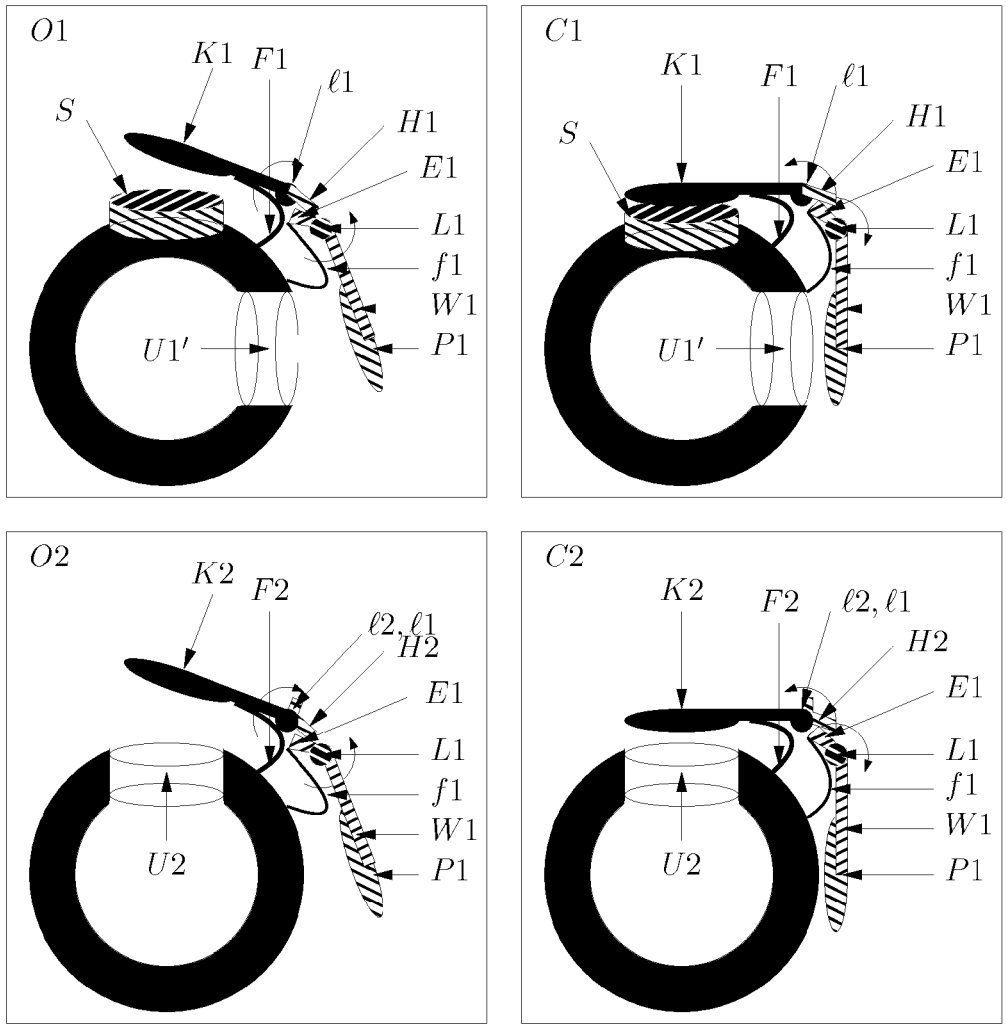
FIG. 8 are schematic sectional views through the upper joint of an oboe in the vicinity of the first tone hole (Figures $O_1$ and $C_1$) and through to the lower joint of an oboe around the second tone hole (Figures $O_2$ and $C_2$) from the viewpoint of the player with a fingering mechanism according to the fourth embodiment, wherein each of the sections is shown with key in open position ($O_1$ and $O_2$) and in closed position ($C_1$ and $C_2$)
Figure 9:
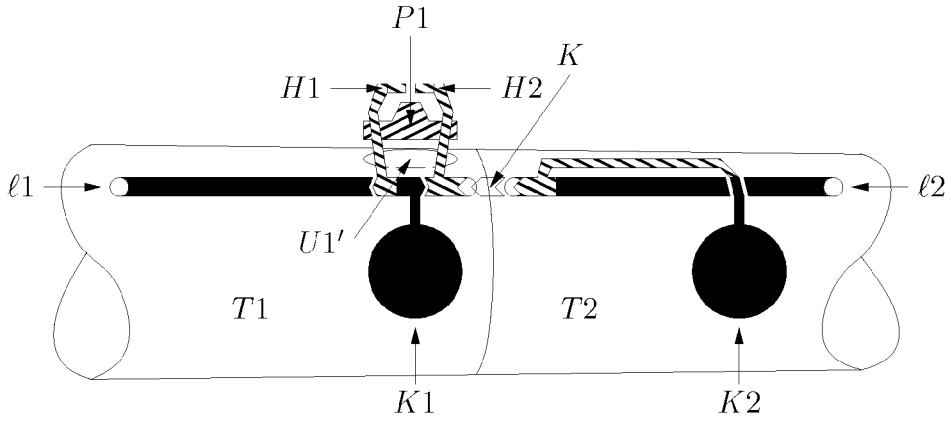
FIG. 9 is a schematic lateral view on a segment of the fingering mechanism around the first and the second tone hole according to the fourth embodiment.

Besides the closely related embodiments described so far, there are further ones with an additional key pivoted at an axis perpendicular to the tube. One of these embodiments is depicted in FIGS. 8 and 9. In this fourth embodiment, the two shafts I1 and I2 are geared in a way that the motion of the key K2 at the upper joint T2 is transferred to the lever H2 which is mounted on the lower joint T1. The constituents of the mechanism implementing this embodiment which correspond with constituents in the embodiments described above are named the same.

The two upper parts of FIG. 8 show, how the lever H1 and the end E1 of the rocker W1 interact. Due to the way the spring f1 is placed at the end E1, without further influences, it holds W1 in closed position. If K1 is opened, the lever H1 and the end E1 of the rocker W1 move towards the tube and the plate P1 at the rocker W1 opens the tone hole U1'. The lever H2, actuated by the second key K2, interacts with E1 like H1 does. Thus P1 opens U1', if either K1 or K2 is open. FIG. 9 shows how the mechanisms are shared between the upper joint T2 and the lower joint T1.

Figure 10:
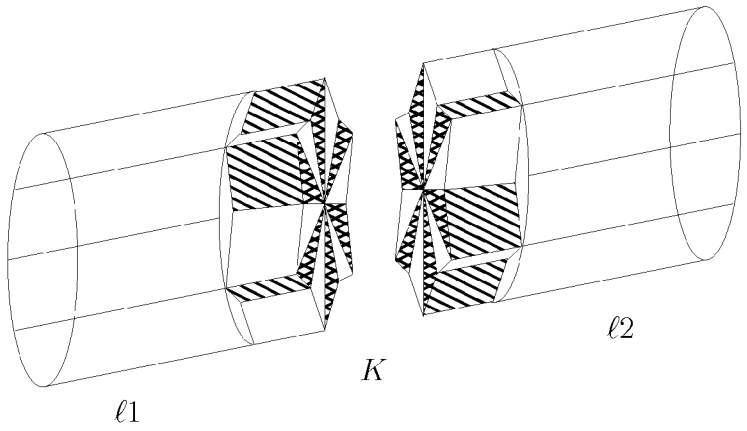
FIG. 10 is a schematic perspective view on the coupling between the two shafts according to the fourth embodiment.

Preferably (but not always), the lever H2 is mounted on the shaft I1, i.e. at the lower joint T1, whereas the key K2 is mounted at the shaft 12, i.e. a the upper joint T2 of the oboe. Thus a coupling K is required to transfer the rotation of the shaft I2 at the upper joint to the shaft I1 on the lower joint. FIG. 10 shows an example for a coupling, comprising complementary crown gears, mounted at the respective ends of the shafts I1 and I2. If the two joints are connected, the crown gears are connected torque proof. Nevertheless, the shafts I1 and I2 can be separated easily by pulling parallel to the shafts. Optionally, H2 can be endowed with a separate spring F2' (not shown), acting in the same direction as F2.

Note that in the lower part of FIG. 8 the key K2 is placed in the foreground on the upper joint of the oboe, whereas the rocker W1 and the adjacent lever H2 is on the lower joint, i.e. in the background.

Figure 11:
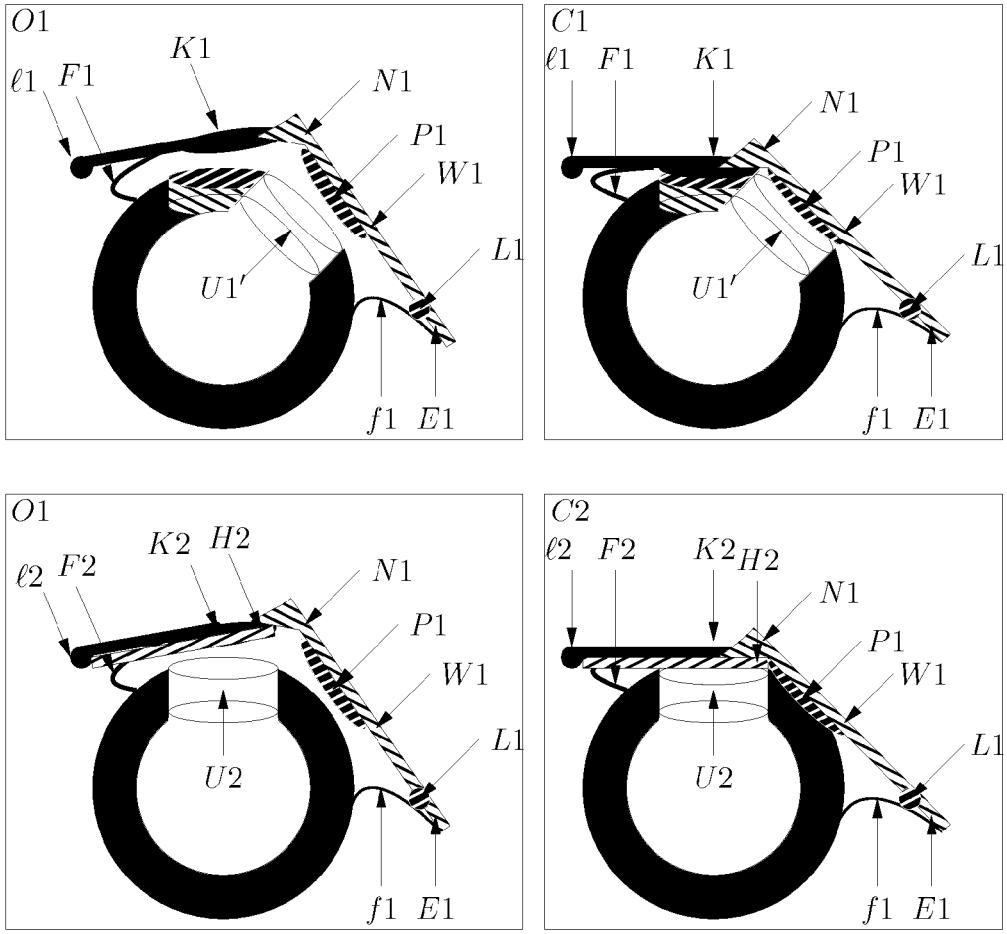
FIG. 11 are schematic sectional views through the upper joint of an oboe in the vicinity of the first tone hole (Figures $O_1$ and $C_1$) and through the lower joint of an oboe in the vicinity of the second tone hole (Figures $O_2$ and $C_2$) viewed from the bell according to the fifth embodiment of the keying mechanism. Each of the sections are shown with key in open position ($O_1$ and $O_2$) and in closed position.

FIG. 11 (which is viewed from the bell) and 12 represent a fifth embodiment, which probably requires modifying the traditional fingering mechanism of the oboe to clear a space for the fingering mechanism of the present disclosure.

The tone hole U1' arises from the original tone hole U1, by rotating it by some degrees clockwise if viewed from the bell. As in the other embodiments, tone hole U1' is covered by a plate P1 mounted on a rocker W1, which is pivoted at a bearing L1 and which is kept by a spring f1 in closed position.

As in the embodiment described above, the added key is transverse to the axis, i.e. approximately in circumferential direction of the tube but this the plate P1 points upwards. Thus K1 gears directly, without additional lever H1, under a nib N1 which is rigidly liked to P1. If the key K is opened, so does the plate P1, but P1 can be open if K1 is closed.

Figure 12:
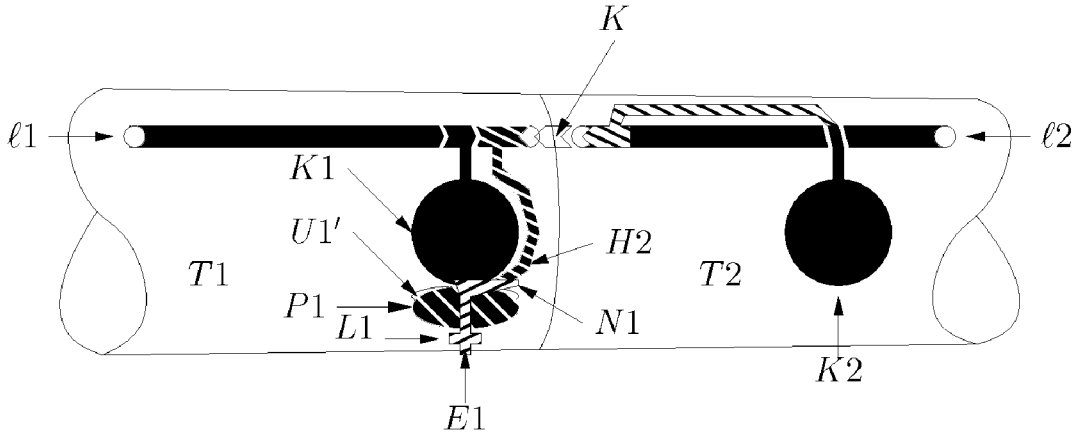
FIG. 12 is a schematic lateral view on a section of the fingering mechanism in the vicinity of the first and the second tone hole according to the fifth embodiment.
Figure 13:
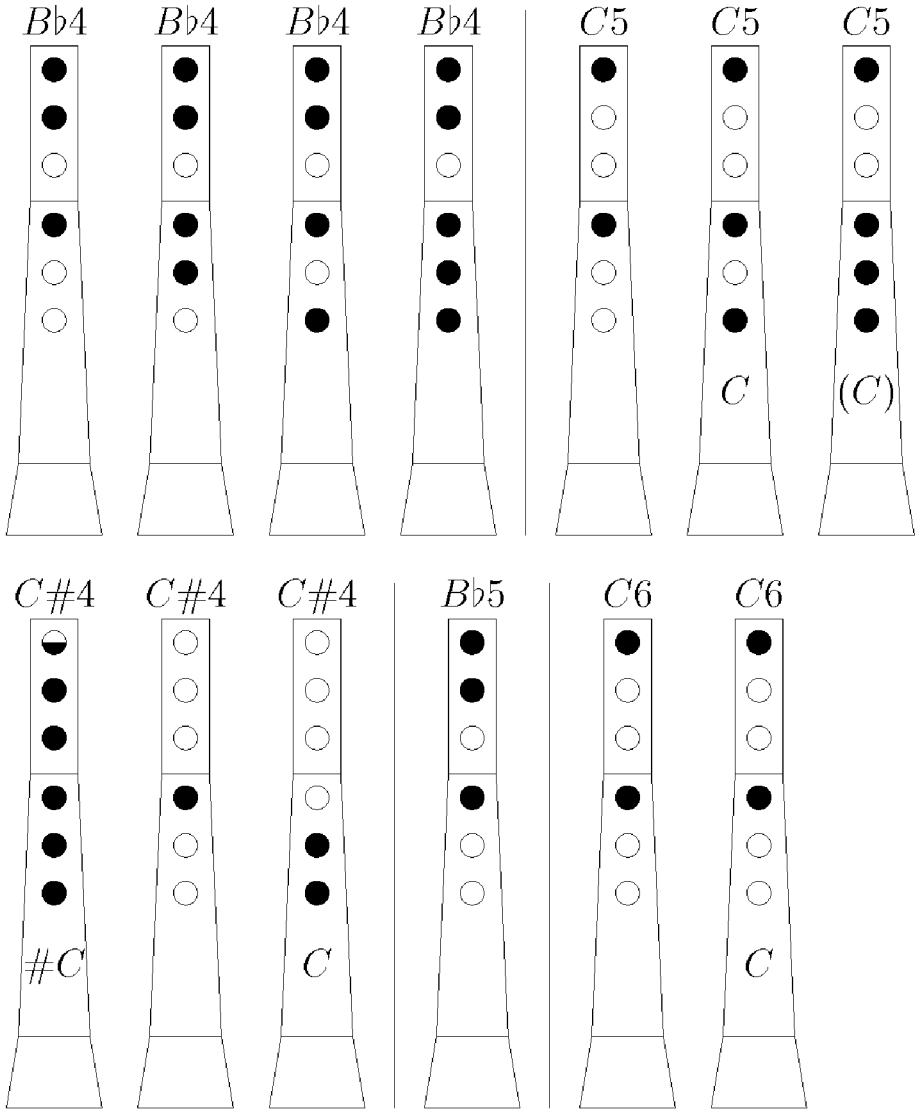
FIG. 13 is a schematic lateral view on an oboe showing only the whole tone holes for various auxiliary fingerings.

Force is transmitted from K2 to P1 in a fashion similar to the previous variant. The lever H2 and the key K1 grip under the asymmetric nib N1 in the same fashion. Note that in the lower part of FIG. 11 the key K2 is on the upper joint, whereas H2 in on the lower joint. Thus not K2, but H2 is in the foreground and actuates W1 via the nib N1. FIG. 12 shows how to transmit force from K2 to P1 via shafts I1 and I2 analogously to FIG. 9.

Based on FIG. 12, the inventor analyzed auxiliary fingerings due to Goossens, Leon & Roxburgh, Edwin: "Die Oboe" (Yehudi Menuhins Musikführer), Edition Sven Erik Bergh, 1979, ISBN 3-88065-107-8, which is incorporated herein by reference. The influence of the fingering mechanism of the present disclosure on the critical fingerings for which the F# key is closed, whereas the g key is open, is as summarized below:

Bb4 The main fingering offers a more open sound and allows more pronounced dynamics. The auxiliary fingerings sound very similar to the main fingering.

C5 The main fingering offers a more beautiful sound with more stable intonation which fits better into the sequence of adjacent notes. The auxiliary fingerings both sound more open and can hardly be distinguished from one another.

C#5 While the sound of the main fingering remains unchanged, the auxiliary fingering sounds better. The effect formerly obtained by the auxiliary fingering can be obtained with a third fingering which is not given by Goosens.

Bb5 For the main fingering, the fingering mechanism of the present disclosure can hardly be distinguished from the traditional one. Auxiliary fingerings remain unchanged.

C6 As for Bb5, the main fingering can hardly be distinguished from the traditional one. The auxiliary fingering sounds a little better with the fingering mechanism of the present disclosure.

I claim:

1. A fingering mechanism for a woodwind instrument comprising a first key that actuates both a first tone hole corresponding to the first key and another remote tone hole, wherein by closing the first key corresponding to the first tone hole, the first tone hole is closed only if a second tone hole that is closer to a mouthpiece, with respect to an air column in a tube of the instrument, than the first tone hole is closed.

2. The fingering mechanism of claim 1, wherein the first tone hole is at least approximately the same distance from the mouthpiece, with respect to the air column in the tube of the instrument, as the first key.

3. The fingering mechanism of claim 1, wherein the first key does not actuate the first tone hole directly, but via a first mechanism.

4. The fingering mechanism of claim 1, wherein the first tone hole is not situated directly underneath the corresponding first key.

5. The fingering mechanism of claim 1, wherein the first tone hole is shifted in a circumferential direction of the instrument with respect to the first key.

6. The fingering mechanism of claim 1, wherein the first tone hole can be closed via an intermediary first mechanism by closing the first key.

7. The fingering mechanism of claim 1, wherein a second mechanism prevents the first tone hole from being closed if the second tone hole is open.

8. The fingering mechanism of claim 1, wherein the second tone hole is closeable by actuating a second key.

9. The fingering mechanism of claim 3, wherein the first mechanism comprises a first rocker held elastically in one of the first rocker's two extreme positions and where the two extreme positions are adjustable via a lever mechanism by actuating the first key.

10. The fingering mechanism of claim 9, wherein the first rocker is mounted at least approximately parallel to an axis of the instrument.

11. The fingering mechanism of claim 9, wherein the first rocker is mounted at least approximately perpendicular to an axis of the instrument.

12. The fingering mechanism of claim 9, further comprising a second mechanism that includes a second rocker held elastically in one of the second rocker's two extreme positions, wherein the first and second rockers are mounted at least approximately parallel to the axis of the instrument and interlock at a respective end of each one.

13. The fingering mechanism of claim 7, wherein the second mechanism comprises a second rocker, held elastically in one of the second rocker's two extreme positions and where two extreme positions are adjustable via a lever mechanism by actuating a second key, further wherein the second tone hole is closeable by actuating the second key.

14. The fingering mechanism of claim 13, wherein the second rocker is mounted at least approximately parallel to an axis of the instrument.

15. The fingering mechanism of claim 13, further comprising a first mechanism that includes a first rocker held elastically in one of the first rocker's two extreme positions, wherein the first and second rockers are mounted at least approximately parallel to the axis of the instrument and interlock at a respective end of each one.

16. The fingering mechanism of claim 1, wherein the first tone hole is actuated by an auxiliary key, the auxiliary key being elastically held in a closed position by an elastic resetting device.

17. The fingering mechanism of claim 16, wherein the first key and a second key actuating the second tone hole are each charged in an open position by an elastic spring device, further wherein the auxiliary key is open if the first key and the second key are each respectively in an open position.

18. The fingering mechanism of claim 1, wherein by closing the first key, at the same time the remote tone hole, in particular a halftone hole, can be opened.

19. The fingering mechanism of claim 1, wherein the woodwind instrument is an oboe, a clarinet or a German flute.

20. The fingering mechanism of claim 1, wherein the woodwind instrument is an oboe, the first tone hole is a f# tone hole, and the second tone hole is a g tone hole.

21. A woodwind instrument comprising a fingering mechanism, in which by pressing a first key, both a first tone hole corresponding to the first key and another remote tone hole can be actuated, wherein by closing the first key corresponding to the first tone hole, the first tone hole is closed only if a second tone hole which is closer to the mouthpiece, with respect to the air column in the tube of the instrument, than the first tone hole is closed.

* * * * *